US011376726B2

(12) United States Patent
Howard

(10) Patent No.: US 11,376,726 B2
(45) Date of Patent: Jul. 5, 2022

(54) MAGNETIC TOOL CONTAINER

(71) Applicant: Jason Howard, Conway, SC (US)

(72) Inventor: Jason Howard, Conway, SC (US)

( * ) Notice: Subject to any disclaimer, the term of this patent is extended or adjusted under 35 U.S.C. 154(b) by 211 days.

(21) Appl. No.: 16/723,944

(22) Filed: Dec. 20, 2019

(65) Prior Publication Data

US 2021/0187726 A1 Jun. 24, 2021

(51) Int. Cl.
*B25H 3/06* (2006.01)
*F21V 33/00* (2006.01)
*B25H 5/00* (2006.01)

(52) U.S. Cl.
CPC ..... *B25H 3/06* (2013.01); *F21V 33/0084* (2013.01); *B25H 5/00* (2013.01)

(58) Field of Classification Search
CPC . B25H 3/06; B25H 3/00; B25H 3/023; B25H 1/12; B25H 3/027; B25H 1/14; B25H 5/00; F16M 11/10; F16M 11/42; F16M 13/00; F16M 11/28; A47B 23/046; F21V 33/0084
USPC ..... 224/547, 562, 553, 564; 248/309.1, 248/206.5, 309.4
See application file for complete search history.

(56) References Cited

U.S. PATENT DOCUMENTS 3,363,775 A * 1/1968 Shaw ..... D05B 91/12 211/70.6
3,522,888 A * 8/1970 Grams ..... B25H 5/00 211/132.1
3,776,387 A * 12/1973 Brent ..... A61B 50/20 211/DIG. 1
4,418,626 A * 12/1983 Semien ..... A47B 31/06 108/44
D283,657 S * 5/1986 Chaplin ..... D6/675
4,826,059 A * 5/1989 Bosch ..... A45C 11/24 211/DIG. 1
4,911,083 A * 3/1990 Considine ..... B25H 5/00 206/327
5,078,281 A * 1/1992 Johnson ..... B25H 3/06 211/DIG. 1
5,699,910 A * 12/1997 Kubat ..... B25H 3/06 206/373
5,760,668 A * 6/1998 Testa ..... B23Q 3/1546 211/DIG. 1

(Continued)

*Primary Examiner* — Anthony D Stashick
*Assistant Examiner* — Prince Pal
(74) *Attorney, Agent, or Firm* — The Iwashko Law Firm, PLLC; Lev Ivan Gabriel Iwashko

(57) ABSTRACT

A magnetic tool container, including a tool storing portion, including a main body to magnetically attract at least one item thereto, at least one elongated receiving aperture disposed on at least a portion of the main body to store at least one first item therein, at least one small receiving aperture disposed on at least a portion of the main body to store at least one second item therein, a mobile device holding portion disposed on at least a portion of a side of the main body to receive a mobile device therein, and at least one illuminating device disposed on at least a portion of a bottom surface of the main body to illuminate a surrounding area thereof, a surface connector to removably connect to a surface, and a moving arm disposed on a first end to the main body and on a second end to the surface connector to connect the tool storing portion to the surface connector, such that the tool storing portion is suspended therefrom.

7 Claims, 3 Drawing Sheets

(56) References Cited

U.S. PATENT DOCUMENTS 6,041,717 A * 3/2000 Kubat ..... B60R 11/06 224/547
6,719,155 B1 * 4/2004 Chang ..... B25H 3/04 211/DIG. 1
6,910,429 B1 * 6/2005 Matay ..... B25H 3/06 108/44
7,802,680 B2 * 9/2010 Krebs ..... B25H 3/04 206/349
10,125,542 B1 * 11/2018 Wandschneider ..... E06C 7/14
10,207,401 B1 * 2/2019 Pedrin ..... B25H 3/003
10,429,000 B2 * 10/2019 Dickinson ..... B60R 13/0206
10,591,108 B2 * 3/2020 Scott ..... B25H 3/00
10,723,015 B1 * 7/2020 Vallow ..... A47B 3/0815
2002/0059887 A1 * 5/2002 Marshall ..... B25H 5/00 108/39
2002/0130231 A1 * 9/2002 Winnard ..... B25H 3/04 248/206.5
2003/0038100 A1 * 2/2003 Liu ..... B25H 3/06 211/88.01
2004/0050891 A1 * 3/2004 Yamamoto ..... B25H 5/00 224/547
2004/0084342 A1 * 5/2004 Chang ..... B25H 3/02 206/378
2005/0204967 A1 * 9/2005 Wrinkle ..... B25H 5/00 108/146
2007/0108072 A1 * 5/2007 Thompson ..... B25H 3/00 206/231
2008/0179268 A1 * 7/2008 Jang ..... B25H 5/00 211/126.1
2009/0218463 A1 * 9/2009 Winnard ..... B25H 3/04 248/309.4
2012/0182749 A1 * 7/2012 MacGregor ..... F21L 14/02 362/486
2013/0186795 A1 * 7/2013 Borrelli ..... B25H 3/021 206/373
2013/0276675 A1 * 10/2013 Guerrero ..... B25H 3/06 108/42
2014/0197292 A1 * 7/2014 Figueroa ..... B25H 3/00 248/227.1
2015/0196370 A1 * 7/2015 Wong ..... A61C 3/04 29/428
2015/0246441 A1 * 9/2015 Huang ..... B25H 5/00 206/557
2017/0029171 A1 * 2/2017 Wang ..... B25H 3/06
2018/0161976 A1 * 6/2018 Kicsak ..... B62B 5/0093
2020/0238481 A1 * 7/2020 Khan ..... B25F 1/04
2021/0007189 A1 * 1/2021 Monteiro ..... H05B 6/44

* cited by examiner

MAGNETIC TOOL CONTAINER

BACKGROUND

1. Field

The present general inventive concept relates generally to a container, and particularly, to a magnetic tool container.

2. Description of the Related Art

Tool containers are usually located at a fixed location, such as on a table and/or a shelf. As such, a user has to constantly move to the tool containers just to retrieve a tool and/or other components.

Additionally, other users may not have a tool container at all because constantly moving back and forth between the tool container and a workspace is inconvenient. Also, the other users are often disorganized and leave their tools out in an open space. As such, the chance of losing tools is significantly increased. In other words, each home project may begin with an idea of saving money, but could end up costing more in the long run from lost tools.

Therefore, there is a need for a mobile tool container that can be moved with the user.

SUMMARY

The present general inventive concept provides a magnetic tool container.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a magnetic tool container, including a tool storing portion, including a main body to magnetically attract at least one item thereto, at least one elongated receiving aperture disposed on at least a portion of the main body to store at least one first item therein, at least one small receiving aperture disposed on at least a portion of the main body to store at least one second item therein, a mobile device holding portion disposed on at least a portion of a side of the main body to receive a mobile device therein, and at least one illuminating device disposed on at least a portion of a bottom surface of the main body to illuminate a surrounding area thereof, a surface connector to removably connect to a surface, and a moving arm disposed on a first end to the main body and on a second end to the surface connector to connect the tool storing portion to the surface connector, such that the tool storing portion is suspended therefrom.

The tool storing portion may further include a recessed surface disposed on a top surface of the main body a predetermined distance away from a top edge of the main body.

The main body may be constructed as a magnet.

The surface connector may magnetically connect to the surface.

The magnetic tool container may further include a power source disposed on at least a portion of the main body to provide power thereto, and a magnetic unit disposed within at least a portion of the main body to generate a magnetic field in response to activating the power source.

The moving arm may be constructed as a magnet.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
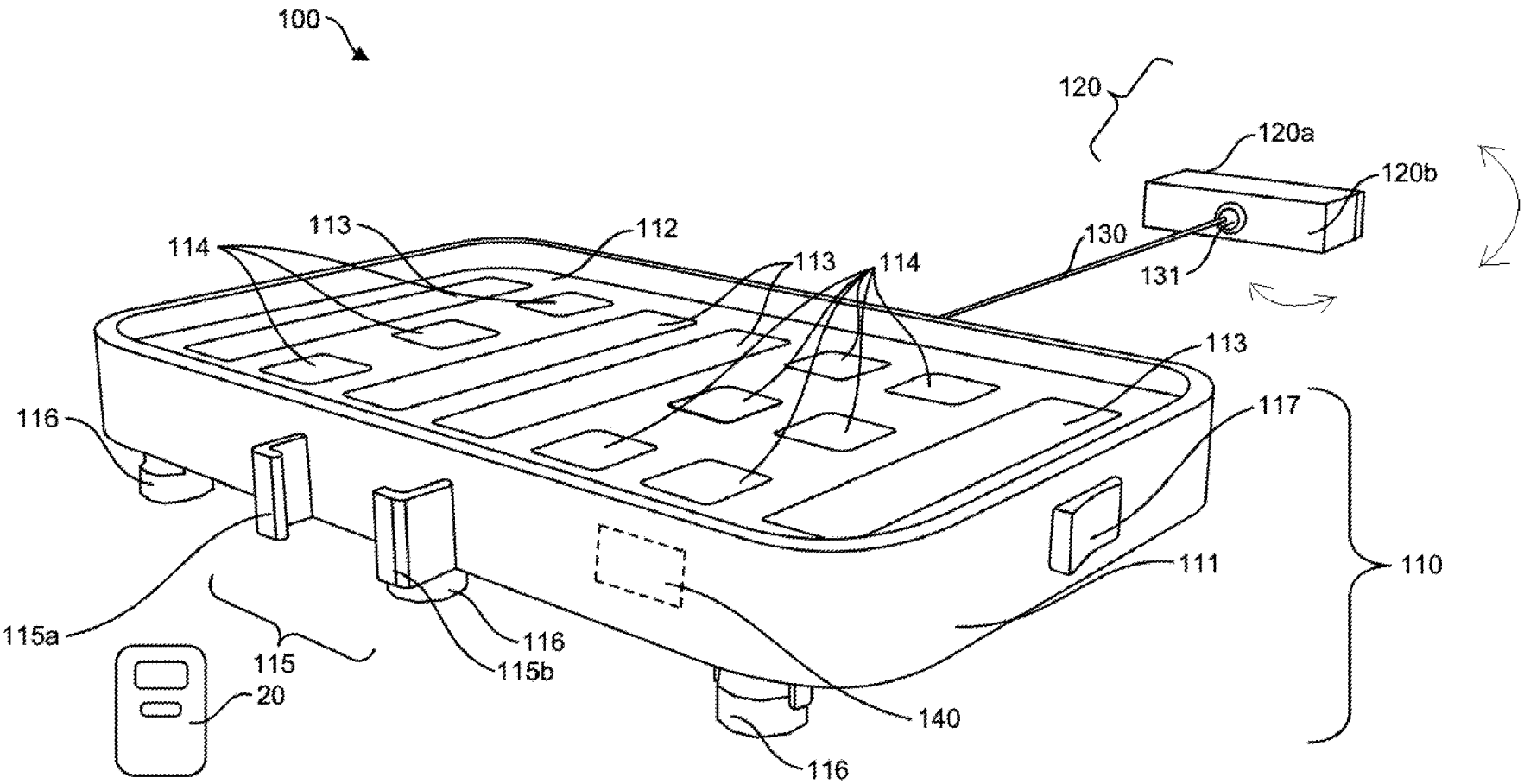
FIG. 1 illustrates an isometric view of a magnetic tool container, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Magnetic Tool Container 100
Tool Storing Portion 110
Main Body 111
Recessed Surface 112
Elongated Receiving Apertures 113
Small Receiving Apertures 114
Mobile Device Holding Portion 115
First Grip 115*a*
Second Grip 115*b*
Illuminating Device 116
Power Button 117
Power Source 118
Surface Connector 120
First Surface 120*a*
Second Surface 120*b*
Moving Arm 130
First Connector 131
Second Connector 132
Magnetic Unit 140

FIG. 1 illustrates an isometric view of a magnetic tool container 100, according to an exemplary embodiment of the present general inventive concept.

Figure 2:
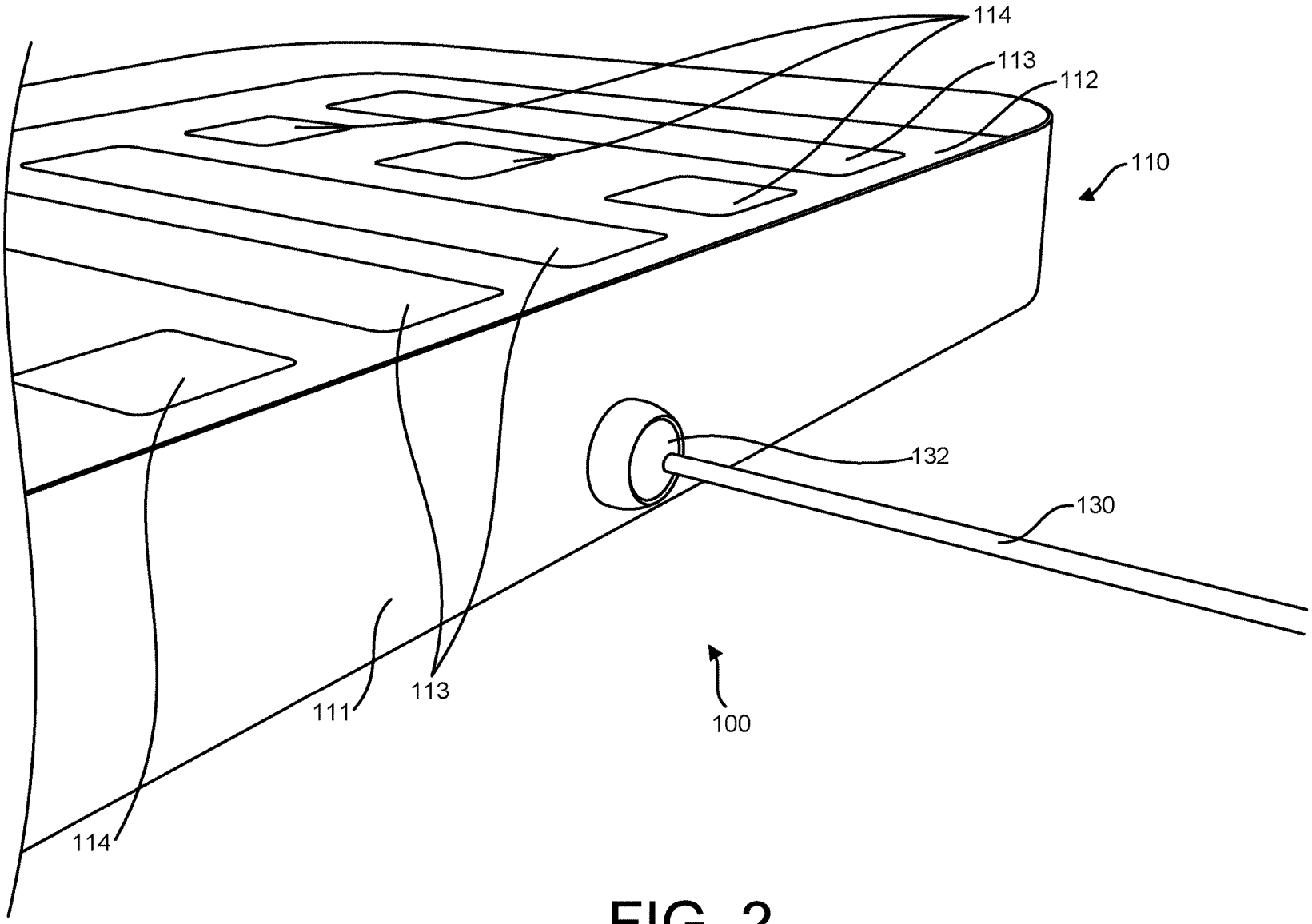
FIG. 2 illustrates a top perspective view of the magnetic tool container, according to an exemplary embodiment of the present general inventive concept.

FIG. 2 illustrates a top perspective view of the magnetic tool container 100, according to an exemplary embodiment of the present general inventive concept.

Figure 3:
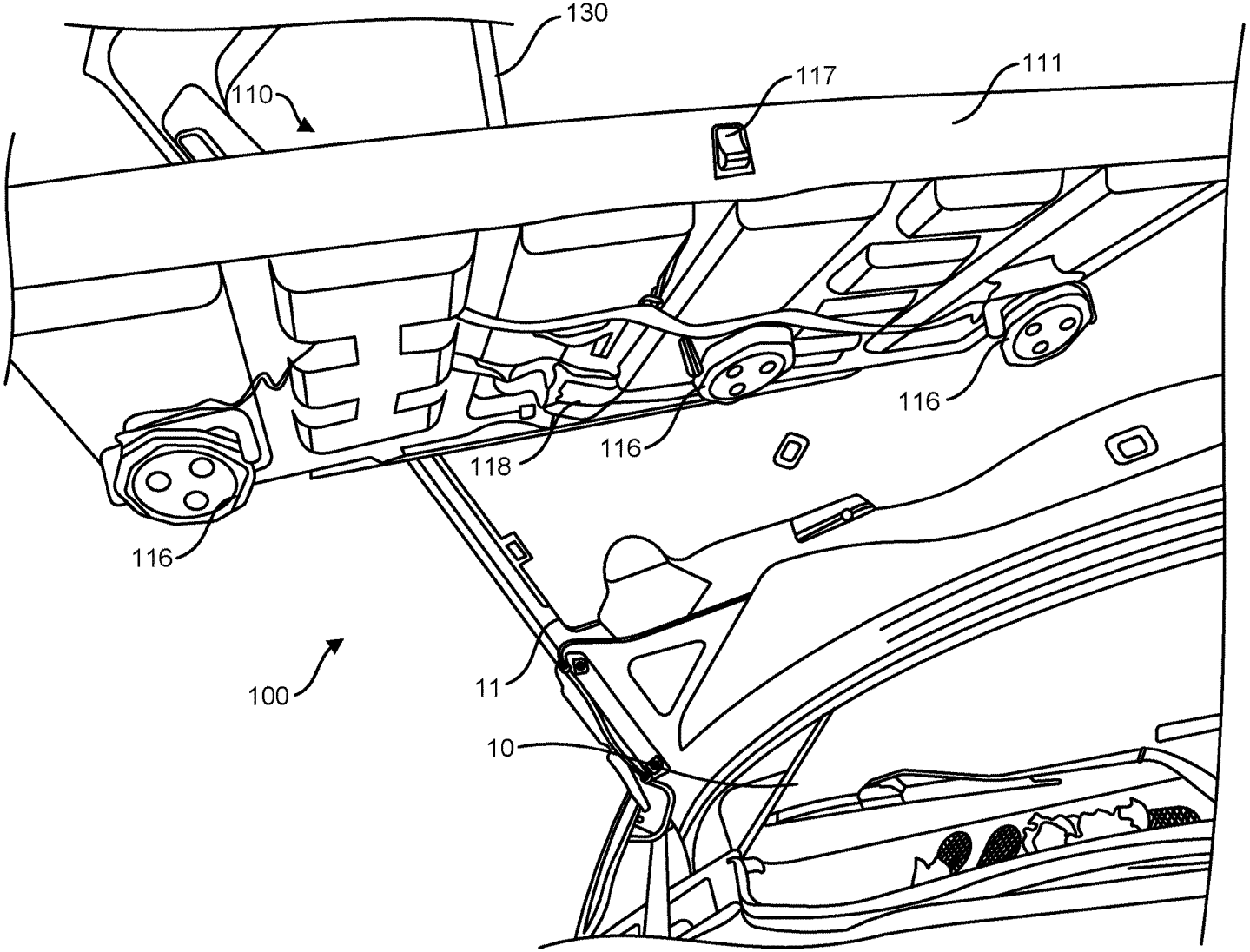
FIG. 3 illustrates a bottom perspective view of the magnetic tool container, according to an exemplary embodiment of the present general inventive concept.

FIG. 3 illustrates a bottom perspective view of the magnetic tool container 100, according to an exemplary embodiment of the present general inventive concept.

The magnetic tool container 100 may be constructed from at least one of metal, plastic, wood, ceramic, glass, and rubber, etc., but is not limited thereto.

The magnetic tool container 100 may include a tool storing portion 110, a surface connector 120, a moving arm 130, and a magnetic unit 140, but is not limited thereto.

The tool storing portion 110 may include a main body 111, a recessed surface 112, a plurality of elongated receiving apertures 113, a plurality of small receiving apertures 114, a mobile device holding portion 115, at least one illuminating device 116, a power button 117, and a power source 118, but is not limited thereto.

Referring to FIGS. 1 and 2, the base cooler receptacle 110 may include a first side 110*a*, a second side 110*b*, a third side 110*c*, a fourth side 110*d*, a fifth side 110*e*, a sixth side 110*f*, a top portion 111, and a bottom portion 112, but is not limited thereto.

The main body 111 may be magnetic on at least a portion thereof. As such, the main body 111 may attract a ferromagnetic item thereto. As such, the main body 111 may prevent the ferromagnetic item from moving away therefrom, such that the ferromagnetic item may be prevented from being lost.

The recessed surface 112 may be disposed on at least a portion of a top surface of the main body 111. The recessed surface 112 may be recessed a predetermined distance with respect to a top edge of the main body 111.

The plurality of elongated receiving apertures 113 may be disposed along at least a portion of the recessed surface 112. Moreover, a length of each of the plurality of elongated receiving apertures 113 may at least partially extend a length and/or a width of the recessed surface 112.

Each of the plurality of elongated receiving apertures 113 may store at least one first item therein. For example, each of the plurality of elongated receiving apertures 113 may store a screwdriver, a wrench, and/or a hammer therein.

The plurality of small receiving apertures 114 may be disposed on at least a portion of the recessed surface 112. Moreover, a length of each of the plurality of small receiving apertures 114 may be less than a length of each of the plurality of elongated receiving apertures 113. For example, each of the plurality of small receiving apertures 114 may be rectangular shaped and/or circular shaped.

Each of the plurality of small receiving apertures 114 may store at least one second item therein. For example, each of the plurality of small receiving apertures 114 may store a screw, a nail, a bolt, and/or a washer therein.

The mobile device holding portion 115 may include a first grip 115*a* and a second grip 115*b*, but is not limited thereto.

The mobile device holding portion 115 may be disposed on at least a portion of a side of the main body 111 to receive a mobile device 20 therein. The mobile device 20 may include a cell phone, a tablet, and a personal digital assistant (PDA), but is not limited thereto.

The first grip 115*a* and the second grip 115*b* may each have an L-shape. The second grip 115*b* may be disposed a distance away from the first grip 115*a*. The first grip 115*a* may have a first portion perpendicularly disposed away from the main body 111 with respect to a first direction. The second grip 115*b* may have another first portion perpendicularly disposed away from the main body 111 with respect to the first direction. Moreover, the first grip 115*a* may have a second portion perpendicularly disposed away from the first portion toward the second grip 115*b*. Similarly, the second grip 115*b* may have another second portion perpendicularly disposed away from the another first portion at least partially toward the first grip 115*a*, such that the first grip 115*a* and the second grip 115*b* may hold the mobile device 20 therebetween.

For example, the mobile device 20 may be used to retrieve instructional videos to be played while a user is performing repairs and/or working on a construction project. As such, the mobile device holding portion 115 may store the mobile device 20, such that the user may view the instructional video from a convenient position, while the user is working.

The at least one illuminating device 116 may include at least one light-emitting diode (LED), a glow-in-the-dark substrate, etc., but is not limited thereto.

Referring to FIG. 3, the at least one illuminating device 116 may be disposed on at least a portion of a bottom surface of the main body 111. The at least one illuminating device 116 may illuminate to at least partially increase visibility of a surrounding area thereof. For example, the at least one illuminating device 116 may illuminate a portion of a vehicle 10 under a hood 11. As such, the at least one illuminating device 116 may prevent the user from injury while working in low light conditions.

The power button 117 may be disposed on at least a portion of another side of the main body 111. The power button 117 may turn on and/or turn off the at least one illuminating device 116.

The power source 118 may include a power inlet and a battery, such as lithium-ion, nickel cadmium, nickel metal hydride, alkaline, etc., but is not limited thereto.

The power source 118 may be disposed on at least a portion of the main body 111. The power source 118 may provide power to the at least one illuminating device 116, the power button 118, and the magnetic unit 140, but is not limited thereto.

The surface connector 120 may include a first surface 120*a* and a second surface 120*b*, but is not limited thereto.

The surface connector 120 may be constructed to be magnetic, such that the surface connector 120 may removably connect to a ferromagnetic surface. For example, the surface connector 120 may removably connect to the hood 11 of the vehicle 10 along at least a portion of the first surface 120*a*.

Referring to FIGS. 1 and 2, the moving arm 130 may include a first connector 131 and a second connector 132, but is not limited thereto.

The first connector 131 may be rotatably disposed on at least a portion of the second surface 120*b* to rotate in any direction. In other words, the first connector 131 may be a ball joint to rotate in any direction. Furthermore, the first connector 131 may hold a position after movement, such that the moving arm 130 may be prevented from movement without manipulation by the user.

The second connector 132 may be rotatably disposed on at least a portion of the main body 111 to rotate in any direction. In other words, the second connector 132 may be a ball joint to rotate in any direction. Furthermore, the second connector 132 may hold a position after movement, such that the moving arm 130 may be prevented from movement without manipulation by the user.

The moving arm 130 may extend a predetermined length between the first connector 131 and the second connector 132. Also, the moving arm 130 may be constructed to be magnetic, such that the moving arm 130 may receive another ferromagnetic item along at least a portion thereof, such that the moving arm 130 may store the another ferromagnetic item thereupon. Additionally, the tool storing portion 110 may be suspended from the moving arm 130 while the surface connector 120 is connected to the hood 11.

The magnetic unit 140 may include a Helmholtz coil pair, a high-current waveform amplifier, and/or any other magnetic field generator, but is not limited thereto.

The magnetic unit 140 may be disposed within at least a portion of the main body 111 to generate a magnetic field within the magnetic tool container 100 in response to turning on the power source 118 via the power button 117. As such, the magnetic tool container 100 may attract the ferromagnetic item thereto. Alternatively, the magnetic unit 140 may stop creating the magnetic field within the magnetic tool container 100 in response to turning off the power source 118 via the power button 117. As such, the magnetic tool container 100 may facilitate extraction of the ferromagnetic item therefrom.

Alternatively, the main body 111, the surface connector 120, and/or the moving arm 130 may be constructed as a magnet.

Therefore, the magnetic tool container 100 may save time and money for the user by connecting to a workspace area, such that tools may be retrieved in close proximity to the workspace area. Additionally, the magnetic tool container 100 may illuminate the workspace area under emergency conditions when external lighting is unavailable.

The present general inventive concept may include a magnetic tool container 100, including a tool storing portion 110, including a main body 111 to magnetically attract at least one item thereto, at least one elongated receiving aperture 113 disposed on at least a portion of the main body 111 to store at least one first item therein, at least one small receiving aperture 114 disposed on at least a portion of the main body 111 to store at least one second item therein, a mobile device holding portion 115 disposed on at least a portion of a side of the main body 111 to receive a mobile device 20 therein, and at least one illuminating device 116 disposed on at least a portion of a bottom surface of the main body 111 to illuminate a surrounding area thereof, a surface connector 120 to removably connect to a surface, and a moving arm 130 disposed on a first end to the main body 111 and on a second end to the surface connector 120 to connect the tool storing portion 110 to the surface connector 120, such that the tool storing portion 110 is suspended therefrom.

The tool storing portion 110 may further include a recessed surface 112 disposed on a top surface of the main body 111 a predetermined distance away from a top edge of the main body 111.

The main body 111 may be constructed as a magnet.

The surface connector 120 may magnetically connect to the surface.

The magnetic tool container 100 may further include a power source 118 disposed on at least a portion of the main body 111 to provide power thereto, and a magnetic unit 140 disposed within at least a portion of the main body 111 to generate a magnetic field in response to activating the power source 118.

The moving arm 130 may be constructed as a magnet.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A magnetic tool container, comprising:

a tool storing portion, comprising:

a main body to magnetically attract at least one item thereto throughout an entirety of each surface of the main body creating an entire shape of the main body, at least one elongated receiving aperture disposed on at least a portion of the main body to store at least one first item therein, at least one small receiving aperture disposed on at least a portion of the main body to store at least one second item therein, a mobile device holding portion disposed on at least a portion of a side of the main body to receive a mobile device therein, and at least one illuminating device disposed on at least a portion of a bottom surface of the main body to illuminate a surrounding area thereof;

a surface connector to removably connect to a surface; and a moving arm disposed on a first end to the main body and on a second end to the surface connector to connect the tool storing portion to the surface connector, such that the tool storing portion is suspended therefrom.

2. The magnetic tool container of claim 1, wherein the tool storing portion further comprises:

a recessed surface disposed on a top surface of the main body a predetermined distance away from a top edge of the main body.

3. The magnetic tool container of claim 1, wherein the main body is constructed as a magnet.

4. The magnetic tool container of claim 1, wherein the surface connector magnetically connects to the surface.

5. The magnetic tool container of claim 1, further comprising:

a power source disposed on at least a portion of the main body to provide power thereto; and a magnetic unit disposed within at least a portion of the main body to generate a magnetic field in response to activating the power source.

6. The magnetic tool container of claim 1, wherein the moving arm is constructed as a magnet.

7. A magnetic tool container, comprising:

a tool storing portion, comprising:

a main body to magnetically attract at least one item thereto throughout an entirety of each surface of the main body creating an entire shape of the main body, at least one elongated receiving aperture disposed on at least a portion of the main body to store at least one first item therein, at least one small receiving aperture disposed on at least a portion of the main body to store at least one second item therein, a mobile device holding portion disposed on at least a portion of a side of the main body to receive a mobile device therein, and at least one illuminating device disposed on at least a portion of a bottom surface of the main body to illuminate a surrounding area thereof;

a surface connector to removably connect to a surface; and a moving arm disposed on a first end to the main body and on a second end to the surface connector to connect the tool storing portion to the surface connector, such that the tool storing portion is suspended therefrom, the moving arm comprising:

a first connector rotatably disposed on at least a portion of the surface connector to rotate in any direction with respect to a first ball joint, and a second connector rotatably disposed on at least a portion of the main body to rotate in any direction with respect to a second ball joint.

* * * * *